United States Patent [19]

Andricos

[11] Patent Number: 4,652,883

[45] Date of Patent: Mar. 24, 1987

[54] RADAR SIGNAL PHASE SHIFTER

[75] Inventor: Constantine Andricos, Pasadena, Calif.

[73] Assignee: ITT Corporation, New York, N.Y.

[21] Appl. No.: 731,414

[22] Filed: May 6, 1985

[51] Int. Cl.[4] ..... H01Q 3/22; H01Q 3/24; H01Q 3/26

[52] U.S. Cl. ..... 342/372; 333/139; 333/164

[58] Field of Search ..... 343/371, 372, 377, 700 MS, 343/754; 333/139, 164

[56] References Cited

U.S. PATENT DOCUMENTS 3,436,691 4/1969 Hoffman et al. ..... 333/164

4,471,330 9/1984 Naster et al. ..... 333/164

4,586,047 4/1986 Inacker et al. ..... 343/372

*Primary Examiner*—Theodore M. Blum

*Attorney, Agent, or Firm*—T. L. Peterson; J. S. Christopher

[57] ABSTRACT

A radar phase shifter is described, of the type which includes several phase shift devices whose phase shift angles can be added together, which produces a minimal VSWR and an accurately controllable total phase shift. A five bit phase shifter includes devices that phase shift by angles that are nominally 11.25°, 22.5°, 45°, 90°, and 180°. The 45° device is located between the 90° and 180° devices to minimize the VSWR. In addition to the preset phase shift devices, an analog phase shifter device is provided which compensates for the inaccuracy of the other devices.

10 Claims, 3 Drawing Figures

RADAR SIGNAL PHASE SHIFTER

BACKGROUND OF THE INVENTION

A phased-array radar system can include a large number of (e.g. several thousand) modules that each include a phase shifter leading to an amplifier which leads to an antenna. By maintaining a selected phase shift for each of the numerous modules, the radar can direct and receive a beam along a selected direction, with very low side lobes. It is desirable to minimize side lobes in transmission to minimize wasted power, and it is especially important to minimize side lobes in reception to minimize the effect of any extraneous noise such as from a jammer that transmits unwanted radar signals.

One type of phase shifter used in each module includes several phase shift devices of progressively greater phase shift angles, which are coupled to locations spaced along a conductor that carries a radar signal. Depending upon which of the shift devices is switched on, any one of a large number of total phase shifts can be achieved. Such a phase shifter may include a few loaded line type phase shifters that can each produce a phase shift of less than 90°, plus one or more reflection type phase shifters that can each produce a phase shift of 90° or a multiple thereof. The reflection type wave shifters have a low VSWR (voltage standing wave ratio), while the loaded line type phase shifters produce higher VSWR with the amount increasing for devices that produce greater phase shifts. A phase shifter which minimized the VSWR resulting from a loaded line type phase shift device of large phase shift such as at least 30°, would reduce the overall VSWR of the phase shifter.

In a phase shifter having a particular number of phase shift devices, each device may produce a phase shift one-half of the previous device, so that the total phase shift can be increased in minimal steps with the least number of phase shift devices. For example, in a five bit phase shifter, the five devices may each produce phase shifts of 11.25°, 22.5°, 45°, 90°, and 180°. Where the devices are formed on a single chip, such as of galium arsenide, the phase shift produced by any device will typically vary by up to about 2° to 3° from the nominal level. It is difficult to compensate for such errors, especially since the total phase shift error depends upon the particular combination of phase shift devices which are activated and the particular error of each device. A phase shifter which included easily set means for correcting the effect of errors in the phase shifts of the shifter devices, would be of considerable value.

SUMMARY OF THE INVENTION

In accordance with one embodiment of the present invention, a phase shifter useful in a phased array radar system is provided which produces high performance at relatively low cost. The phase shifter includes a plurality of distinct phase shift devices that can each be switched on or off so that the total phase shift depends upon the devices that are switched on. Where two of the devices are reflection type phase shift devices, which may be 90° and 180° shifter devices, and other shift devices are loaded line types with one having a high phase shift angle of at least about 30°, the high VSWR produced by high angle loaded line phase shift device is absorbed by placing it between the two reflection type phase shift devices. Differences between the nominal phase shift and actual phase shift of each device is compensated for by an analog phase shift circuit whose phase shift is dependent upon the particular phase shifter devices that are switched on at any given time.

The novel features of the invention are set forth with particularity in the appended claims. The invention will be best understood from the following description when read in conjunction with the accompanying drawings.

DESCRIPTION OF THE PREFERRED EMBODIMENT

Figure 1:
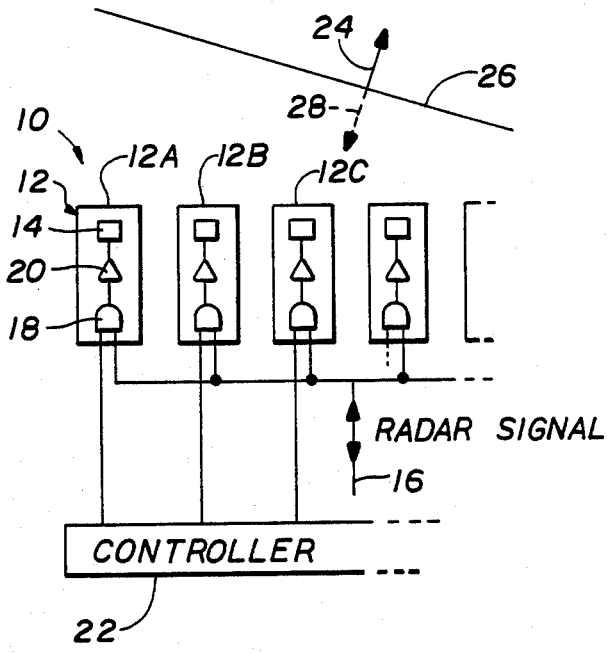
FIG. 1 is a partial schematic diagram of a phased-array radar system constructed in accordance with the present invention.

FIG. 1 illustrates a phased-array radar system 10 which includes numerous modules 12 which each include an antenna 14 for transmitting and receiving microwaves. In the transmission of a radar signal, the radar signal is delivered over line 16 to each of the modules 12. At each module 12, the signal is phase shifted by a phase shifter 18 of the module 12, amplified by an amplifier 20 of the module 12, and delivered to the antenna 14 for radiating the signal at a target. A controller 22 controls the phase shift of each of the numerous modules 12, to control the direction of the transmitted radar beam, as to transmit in the direction of arrow 24 so that the wavefront lies along a line such as 26 perpendicular to the transmission direction. The same system can receive a radar signal indicated by arrow 28, which may be a reflection from a target. The received signal 28 is detected by the antennas 14, amplified, and phase shifted by the phase shifters 18, to deliver a signal along line 16 which represents microwaves picked up along a narrow direction. In order to obtain high directionality, the angle of the phase shifters 18 must be closely controlled at each of many different possible angles that are used for directing beams in different directions.

Figure 2:
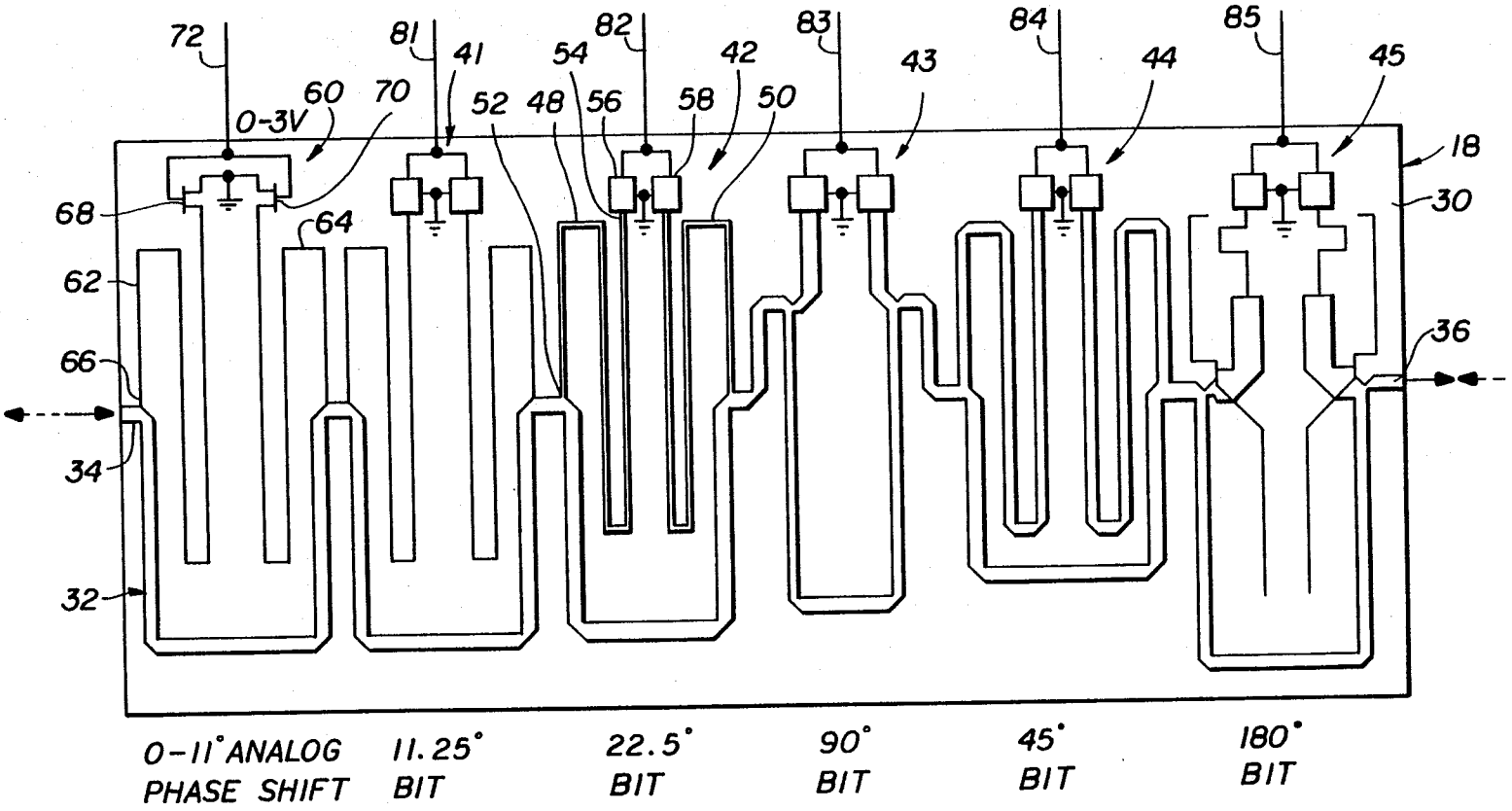
FIG. 2 is a partial plan view and partial schematic view of a phase shifter useful in the system of FIG. 1.

FIG. 2 shows details of one of the phase shifters or phase shift apparatuses 18. The entire phase shifter 18 can be formed on a single chip 30 of a semiconductor material such as gallium arsenide. The circuit includes a conductor 32 which has one end 34 that serves as an input for signals to be transmitted by the system, and an opposite end 36 which serves as an output leading to the amplifier 20 for such signals. It should be noted that received signals travel in the opposite direction through the phase shifter 18, and signals undergo the same phase shift for either direction. The phase shifter 18 includes five bit (fixed) shift devices 41–45 with each having a predetermined nominal phase shift value. The greatest angle shift device 45 produces a 180° shift of signals passing thereby, and the other four devices each produce one-half the shift of the previous device, so that the phase shifts are 180°, 90°, 45°, 22.5°, and 11.25°. This allows the minimum number of phase shift devices to be used to obtain phase shifts in steps of about 11°, from about 0° to almost 360°.

Three of the shift devices 41, 42, and 44 are of the loaded line type, with each including a pair of fixed impedance transmission lines such as 48 and 50 with each having one end 52 connected to the conductor 32 and with each having an opposite end 54 which can be grounded. A pair of transistors such as FET (field effect transistor) types 56, 58 can be used to "switch on" or "activate" the shift device 42 by grounding its ends 54 so that that device 42 adds a predetermined shift such as 22.5° to a signal traveling through the conductor 32. Two of the phase shift devices 43 and 45 which produce phase shifts which are multiples of 90°, are of the reflection type, which includes a quadrature coupler 59. The reflection types 43, 45 are desirable in that they add very little to the VSWR (voltage standing wave ratio) along the conductor 32. However, they are useful primarily only for phase shifts that are approximately multiples of 90°. The loaded line type phase shifters 41, 42, and 44 are easily constructed to produce any of a wide range of lower phase shifts, but they have the disadvantage that they contribute to the VSWR, with the contribution increasing greatly as the phase shift angle increases. The contribution to the VSWR becomes substantial for loaded line type phase shifters 41, 42 and 44 which have a phase shift of at least 30° or more. Thus, the device 44 which produces a 45° phase shift, produces a high level VSWR because the error in the phase shift is directly related to the VSWR. Generally, the lower the VSWR, the smaller the error in the phase shift.

Applicant has considered the fact that the reflection type phase shifter devices 43, 45 not only produce very little VSWR, but also absorb much of the VSWR in the conductor. Applicant avoids the deleterious effects of the high level of VSWR produced by the 45° phase shift device 44, by placing that device 44 between the two reflection type phase shifters 43, 45. For transmitted signals, the device 45 absorbs the high level VSWR produced by the device 44. For received signals travelling in the opposite direction along the conductor, the device 43 absorbs the high level of VSWR produced by the device 44. Accordingly, by placing the large angle (at least 30°) loaded line phase shifter device 44 between the two reflection type phase shift devices 43, 45, instead of merely placing the devices in order of their phase shift, applicant provides a phase shifter 18 of relatively low VSWR. Only one of the loaded line type phase shift devices 41, 42 or 44 should be placed between the two reflectance devices 43, 45; if two or three of the devices 41,42, 44 are placed between the devices 43, 45 then the VSWR is not almost totally absorbed.

Although the phase shift devices 41–45 can be constructed to the nominal values shown of 11.25°, 22.5°, 90°, 45°, and 180°, actual values may vary by up to about ±3 degrees. If the total phase angle shift deviates considerably from the desired phase angle shift, then appreciable side lobes will occur in the transmitted and received beams. The transmitted beam along the desired direction will then be somewhat weaker while unwanted radiation is transmitted in other directions, and the received beam will include microwave radiation from other than the desired direction. Applicant compensates for deviation from the nominal values by the provision of a variable analog phase shift circuit 60. The analog circuit 60 is largely similar to the 11.25° shift device 41, in that it includes two quarter wave transmission lines 62, 64 having outer ends 66 coupled to the conductor 32 and inner ends 67 coupled through a pair of transistors such as FET transistors 68, 70 to ground. However, instead of operating the transistors 68, 70 in a digital fashion, with the input being either 0 (not connected to ground) or −3 v (shorted to ground), applicant applies a variable voltage to the gates of the FET's 68, 70, through a variable shift control line 72.

Figure 3:
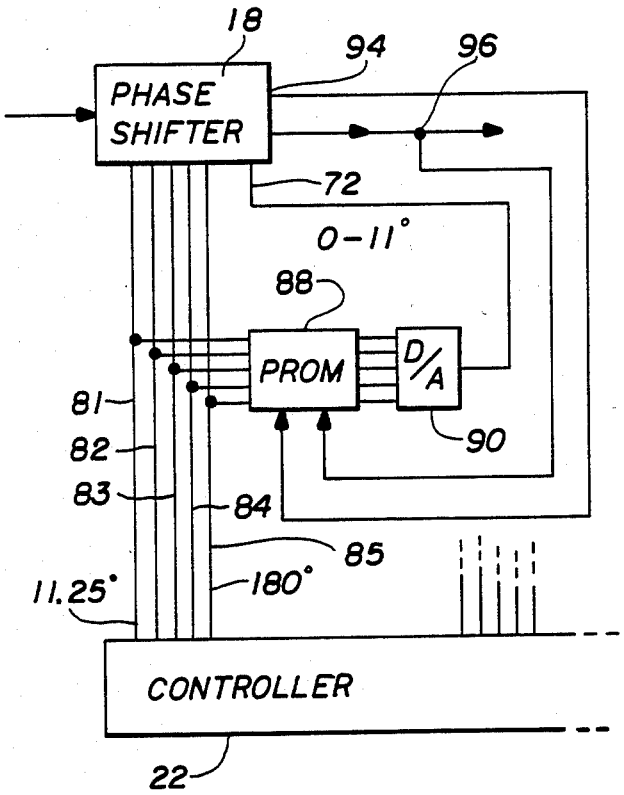
FIG. 3 is a partial schematic diagram of a portion of the system of FIG. 1.

FIG. 3 illustrates the circuitry for controlling the phase shifter 18, and especially for controlling the voltage applied to the variable shift control line 72 thereof. The circuit of FIG. 3 shows five output lines 81–85 extending between the controller 22 and the shift devices 41–45 of the phase shifter 18, to determine which of the five bit shift devices is to be operated at any given time. The lines 81–85 carry digital signals, which are either "on" (when they have a level of −3 v) or "off" (when they have a level of 0 volts). A programmable memory 88 senses the states of each of the five lines 81–85 and generates a number which it delivers to a digital-to-analog converter 90. The converter 90 generates a corresponding analog signal of between 0 and −3 volts, which it delivers to the analog phase shift circuit 60 to determine which phase shift between 0° and 11° the analog phase shift circuit 60 applies.

Each of the lines 81–85 extending between the controller 22 and the phase shift devices 41–45 is in either one of two states. Accordingly there are only thirty-two possible combinations of the five lines ($2^5=32$). The memory 88 stores 32 numbers, each corresponding to one of the thirty-two different patterns of signals on the lines 81–85. Each stored number represents a particular analog phase shift between 0° and 11° which must be applied, to compensate for the deviations between actual and nominal values of phase shift for all of the phase shift devices 41–45 which are switched on for a given pattern of signals on the lines 81–85. Each of the thirty-two numbers stored in the memory 88 can be determined by testing the phase shifter 18 when each of the thirty-two different patterns of digital signals are applied on lines 81–85. Of course, this can be simplified in a number of different ways as by measuring the deviation of each of the five bit phase shift devices 41–45 and generating the thirty-two numbers from them. Since each of the numerous phase shifters 18 in a radar system will have a different pattern of deviation of their bit phase shift devices 41–45 from their nominal values, each of the memories of each of the numerous modules 12 of the radar system 10 will have a unique set of thirty-two numbers in its memory 88, which will be different from the set of numbers in most of the other modules 12.

The output of the phase shifter 18 which includes the analog phase shift circuit 60 is, at any time, equal to the total of the nominal phase shift angles of devices that are activated, plus a constant (which is here equal to 5.5°). As an example, it may be assumed that the phase shift devices 41–45 have deviations from their nominal values of +2°, +1°, 0.5°, −1.5°, and −2°, respectively. When all phase shifters are off, the analog circuit 60 produces a shift of +5.5°. When only devices 41 and 43 are on they produce a nominal total shift of 101.25°, but an actual shift of 103.75° which is 2.5° more than the nominal value of 101.25°. When only devices 42 and 44 are on they produce a nominal total shift of 67.5°, but an actual shift of 67°. In that case, the analog circuit 60 produces a shift of 6° (instead of 5.5°), so the total shift is 73° which is 5.5° more than the nominal value of 67.5°. It is the change in phase shift that is of major importance.

The phase shifts of devices 41–45, and the shift of the analog circuit 60 for a given applied voltage on line 72, varies with the temperature of the phase shifter and the frequency of the radar signal. In order to account for this, the memory 88 includes nine sets of numbers, each set including thirty-two numbers. A temperature sensor 94 senses the temperature of the phase shifter, and signals whether the temperature is above a high temperature (e.g. 110° F.), below a low temperature (e.g. 60° F.), or is inbetween. A frequency sensor 96 senses which of three frequency ranges the radar signal is in. There are nine different possible combinations of temperature and frequency, and each of the nine combinations results in a different set of thirty-two numbers being available from the memory 88.

In one example of operation of the radar system 10 of FIG. 1 which has several thousand modules 12, a first module 12A shifts the radar signal on line 16 by 5.5°. A second adjacent module 12B produces a phase shift of 16.75°, a third 12C produces a shift of 28°, and so forth, with the thirty-second module having a phase shift of 354.25°. The next group of thirty-two modules have the same phase shifts of 5.5°, 16.75° etc. It is important that corresponding modules in each of the numerous groups of thirty-two modules each have the same phase shift, which is assured by the programmed analog variable phase shift circuit 60 in each phase shifter 18. The memory 88 which controls each variable phase shift circuit 60 has a unique set of thirty-two numbers (for a given temperature and frequency) which is different from the set of numbers in the memories 88 used in almost all of the other phase shifters 18.

Thus, the invention provides a phased array radar system 10 with multiple modules 12 that each have bit phase shift devices 18 that can be combined in various patterns to produce a selected total phase shift of signals passing through the phase shifter 18 of the module 12. Where the phase shifter 18 includes at least two reflection type phase shift devices 43, 45 and a plurality of loaded line type phase shift devices 41, 42 and 44 wherein at least one of the loaded line type devices 44 is constructed to produce a phase shift of at least 30°, that loaded line device 44 is placed between the two reflection type phase shift devices 43, 45. This allows the reflection type phase shift devices 43, 45 to absorb the substantial VSWR produced by the large angle loaded line phase shift device 44. The phase shifter 18 can include a variable phase shift circuit 60 which can be controlled to produce any phase shift within a certain range, to compensate for differences between the nominal and actual values of the fixed phase shift devices 41–45 that are individually switched on. The phase shift circuit 60 can be controlled by a memory 88 which responds to the particular fixed shift devices 41–45 that are turned on at any given time, to control the variable phase shift circuit 60 to produce an analog shift which compensates (within about 0.50) for the net sum of the errors of the bit phase shift devices 41–45.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A phase shifter apparatus useful in a phased array radar system for providing any of a set of different phase shift amounts of a radar signal, comprising in combination:

a conductor for carrying a radar signal;

a plurality of fixed phase shift devices disposed along said conductor, each fixed shift device being switchable on to shift the phase of said radar signal by a predetermined amount and being switchable off to avoid phase shifting of the signal, the total phase shift of said radar signal in passage along said conductor being the sum of the predetermined amounts of those devices which are switched on, said fixed phase shift devices including a first device and a second device which provide phase shifts of less than 30° and a third device providing a phase shift of 45°, a fourth device providing a phase shift of 90° and a fifth device providing a phase shift of 180°, said first device, second device and third device each being a loaded line type phase shifter, and said fourth device and said fifth device each being a reflection type phase shifter, said third device coupled to a location along said conductor which lies directly between locations to which said fourth device and said fifth device are coupled along said conductor for maintaining a low voltage standing wave ratio;

a controller coupled to said plurality of phase shift devices, and operable to switch on said devices in any of a plurality of combinations to provide any of a number of total different phase shifts;

a phase shift circuit disposed along said conductor and operable to add a plurality of different phase shifts to the signal on the conductor; and means responsive to the operation of said controller for varying the phase shift of said phase shift circuit in an amount that, when added to the phase shifts of the fixed phase shift devices that are switched on, provides a predetermined total phase shift for each pattern of selected fixed phase shift devices.

2. The apparatus described in claim 1 wherein:

said phase shift circuit includes a pair of fixed impedence transmission lines, each having one end connected to said conductor and an opposite end, and transistor means with an input, for coupling said opposite ends to a ground potential by an equivalent resistance dependent upon a control voltage applied to said transistor means input;

said means for varying the phase shift of said phase shift circuit includes a digital memory which stores information relating each of a plurality of combinations of fixed phase shift devices that are switched on, to each of a plurality of numbers defining a specific control voltage, and a digital-to-analog converter which converts each of said numbers to a control voltage and which has an output coupled to said transistor means input.

3. The apparatus described in claim 1 wherein:

each of said fixed phase shift devices has a nominal phase shift value and also has an actual phase shift value which is the amount by which the phase of said radar signal is actually shifted, and each device has a deviation between said nominal and said actual values; and said means for varying controls of said phase shift circuit to produce a phase shift, for any given combination of said fixed devices that are switched on, so the total phase shift along said conductor equals the sum of the nominal values of the fixed devices that are switched on plus a constant that remains constant for all combination of fixed devices.

4. The apparatus described in claim 1 wherein:

said plurality of phase shift devices includes nominally an 11.25° phase shift in said first fixed phase shift device, a 22.5° phase shift in said second fixed phase shift device, a 45° phase shift in said fourth fixed phase shift device, a 90° phase shift in said third fixed phase shift device and a 180° phase shift in said fifth fixed phase shift device; and said means for varying the phase shift adds sufficient phase shift to provide a total phase shift which is a multiple of 11.25° plus a predetermined constant angle.

5. The apparatus described in claim 1, further including:

a plurality of additional phase shifter apparatuses, all similar to said first mentioned apparatus;

said plurality of phase shift apparatuses each having phase shift devices with the same nominal phase shift value but different actual phase shift values, wherein the combination of the phase shift circuit and the means for varying of each apparatus provides the same actual total phase shift for each phase shifter apparatus when the same combination of phase shifter devices of an apparatus is switched on.

6. In a phase shifter for use in a phased array radar system, including a conductor and a plurality of phase shift devices that are coupled to the conductor and that each have a fixed nominal phase shift value and an actual phase shift value generally deviating from the nominal value, and a controller which generates any of a group of different patterns of digital signals that activate selected phase shift devices to produce a corresponding total phase shift for signals passing through the phase shifter, the improvement of means for providing a total phase shift equal to the nominal values of all devices activated by each pattern of signals from the controller, plus a constant, comprising:

a variable phase shift circuit which has an input and which has an output coupled to said conductor to add a phase shift to signals passing therethrough which varies in accordance with the level of signal to the input of the phase shift circuit;

a digital memory which stores a plurality of numbers, and which has an input which senses the pattern of signals from said controller and an output which carries an output signal representing a unique one of said stored numbers, with the particular number represented by said output signal dependent on the pattern of signals at said memory input; and means for coupling the output signal from said memory to the input of said variable phase shift circuit to vary the level of the signal at the input of the phase shift circuit.

7. The improvement described in claim 6 wherein said variable phase shift circuit includes a transmission line with an outer end connected to said conductor and an inner end, and a transistor which variably couples said inner end of said transmission line to ground, and said coupling means delivers a variable signal to said transistor to control the equivalent resistance across said transistor.

8. A phase shifter used in a phased array radar system for providing any of a set of phase shift amounts of a radar signal, comprising:

a conductor which passes said radar signal;

a plurality of phase shift devices coupled to locations along said conductor, each shift device being switchable on to shift the phase of said radar signal by a fixed amount and being switchable off to avoid affecting the phase of the signal, the total phase shift by said shift devices being the sum of the amounts of those devices which are switched on:

said phase shift devices including first, second, and third devices that provide progressively greater phase shift, and that are each loaded line type phase shift devices, with said first and second devices each providing a phase shift of less than 30° and said third device producing a phase shift of at least 30°;

said fixed phase shift devices including fourth and fifth devices that respectively produce 90° and 180° phase shifts and that are each a reflection type phase shift device;

said third device being coupled to locations along said conductor which are between the locations to which said fourth and fifth devices are coupled, so that a radar signal on said conductor passes through said third device in its path between said fourth and fifth devices, whereby to trap reflections from said third device to maintain a low voltage standing wave ratio.

9. In a radar phase shifter which includes a conductor for carrying a radar signal and a plurality of phase shift devices coupled to said conductor including a plurality of loaded line type phase shift devices that each produce a phase shift of under 90°, and two reflection type phase shift devices that each produce a phase shift which is a multiple of 90°, the improvement for minimizing the voltage standing wave ratio along the line, wherein:

the loaded line type phase shifter which produces the greatest phase shift is coupled to a location along said conductor which is located directly between the locations along said conductor to which said two reflection type phase shifters are coupled.

10. The improvement described in claim 9 wherein:

the loaded line type device which provides the greatest phase shift provides about a 45° phase shift, said loaded line type devices include a nominally 22.5° phase shift device which is coupled to a conductor location which is not between said reflection type phase shifters, and said relection type phase shift respectively provide 90° and 180° phase shifts.

* * * * *